US005933971A

United States Patent [19]

Whaling

[11] Patent Number: 5,933,971

[45] Date of Patent: Aug. 10, 1999

[54] LOG SIZING AND MARKING DEVICE

[76] Inventor: David K. Whaling, P.O. Box 639, Jackson, Calif. 95642

[21] Appl. No.: 08/878,807

[22] Filed: Jun. 19, 1997

[51] Int. Cl.[6] ..... B26B 29/06

[52] U.S. Cl. ..... 33/41.1; 33/41.6; 33/42

[58] Field of Search ..... 33/41.1, 41.6, 33/42, 484, 485, 666, 677

[56] References Cited

U.S. PATENT DOCUMENTS 5,471,753 12/1995 Rodrigues ..... 33/42
5,782,007 7/1998 Harris ..... 33/42
5,842,284 12/1998 Goldman ..... 33/42
5,862,601 1/1999 O'Brien et al. ..... 33/41.5

*Primary Examiner*—Bernard Roskoski

[57] ABSTRACT

A log sizing and marking device including a base member having a slot extending through a rearward end wall and extending a length thereof. An adjustable bracket is secured to an upper surface of the base member. The adjustable bracket is adapted for coupling a can of spray paint to the base member in a horizontally disposed orientation. A sliding ruler is slidably received within the slot extending through the rearward end wall of the base member.

7 Claims, 2 Drawing Sheets

LOG SIZING AND MARKING DEVICE

BACKGROUND OF THE INVENTION

1. Field of the Invention

The present invention relates to a log sizing and marking device and more particularly pertains to measuring logs for cutting at a desired length with a log sizing and marking device.

2. Description of the Prior Art

The use of log sizing apparatuses is known in the prior art. More specifically, log sizing apparatuses heretofore devised and utilized for the purpose of providing logs cut to similar lengths are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,984,371 to Fredrickson; U.S. Pat. No. 4,299,034 to DeBetta; U.S. Pat. No. Des. 268,170 to Youngblom; U.S. Pat. No. 4,951,398 to Bennett et al.; U.S. Pat. No. 4,607,434 to Francis; and U.S. Pat. No. 4,561,186 to Keefe.

While these devices fulfill their respective, particular objective and requirements, the aforementioned patents do not describe a log sizing and marking device for measuring logs for cutting at a desired length.

In this respect, the log sizing and marking device according to the present invention substantially departs from the conventional concepts and designs of the prior art, and in doing so provides an apparatus primarily developed for the purpose of measuring logs for cutting at a desired length.

Therefore, it can be appreciated that there exists a continuing need for new and improved log sizing and marking device which can be used for measuring logs for cutting at a desired length. In this regard, the present invention substantially fulfills this need.

SUMMARY OF THE INVENTION

In the view of the foregoing disadvantages inherent in the known types of log sizing apparatuses now present in the prior art, the present invention provides an improved log sizing and marking device. As such, the general purpose of the present invention, which will be described subsequently in greater detail, is to provide a new and improved log sizing and marking device and method which has all the advantages of the prior art and none of the disadvantages.

To attain this, the present invention essentially comprises a base member having a generally rectangular configuration. The base member has long opposed side walls and short opposed forward and rearward end walls. The base member has an upper surface and a lower surface. The base member has a slot extending through the rearward end wall and extending a length of the base member. An adjustable bracket is secured to the upper surface of the base member. The adjustable bracket is adapted for coupling a can of spray paint to the base member in a horizontally disposed orientation. The adjustable bracket includes a forward bracket extending upwardly from the forward end wall of the base member. The forward bracket has an arcuate recess extending downwardly thereof for receiving a spray nozzle of the can of spray paint therein. The forward bracket includes a tab extending inwardly therefrom for engaging an upper peripheral edge of the can of spray paint. The adjustable bracket includes a rearward bracket disposed inwardly of the rearward end wall of the base member. The rearward bracket comprises a cam lock for releasably engaging a lower peripheral edge of the can of spray paint. The cam lock includes a release handle. A sliding ruler is slidably received within the slot extending through the rearward end wall of the base member.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved log sizing and marking device which has all the advantages of the prior art log sizing apparatuses and none of the disadvantages.

It is another object of the present invention to provide a new and improved log sizing and marking device which may be easily and efficiently manufactured and marketed.

It is a further object of the present invention to provide a new and improved log sizing and marking device which is of durable and reliable construction.

An even further object of the present invention is to provide a new and improved log sizing and marking device which is susceptible of a low cost of manufacture with regard to both materials and labor, and which accordingly is then susceptible of low prices of sale to the consuming public, thereby making such a log sizing and marking device economically available to the buying public.

Even still another object of the present invention is to provide a new and improved log sizing and marking device for measuring logs for cutting at a desired length.

Lastly, it is an object of the present invention to provide a new and improved log sizing and marking device including a base member having a slot extending through a rearward end wall and extending a length thereof. An adjustable bracket is secured to an upper surface of the base member. The adjustable bracket is adapted for coupling a can of spray paint to the base member in a horizontally disposed orientation. A sliding ruler is slidably received within the slot extending through the rearward end wall of the base member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
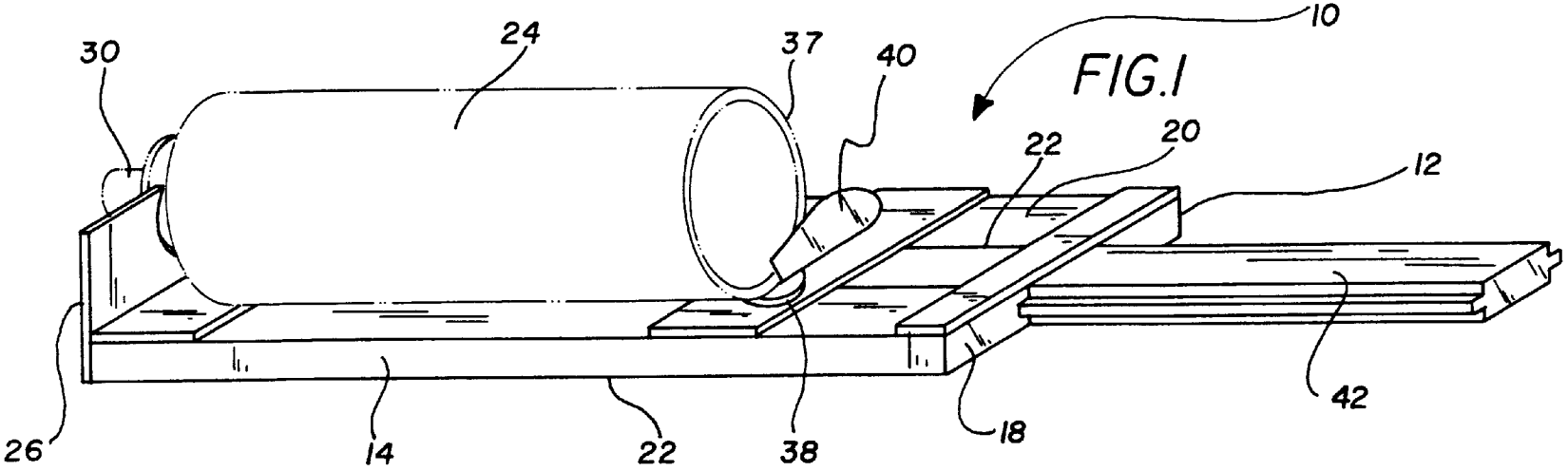
FIG. 1 is a perspective view of the preferred embodiment of the log sizing and marking device constructed in accordance with the principles of the present invention.
Figure 2:
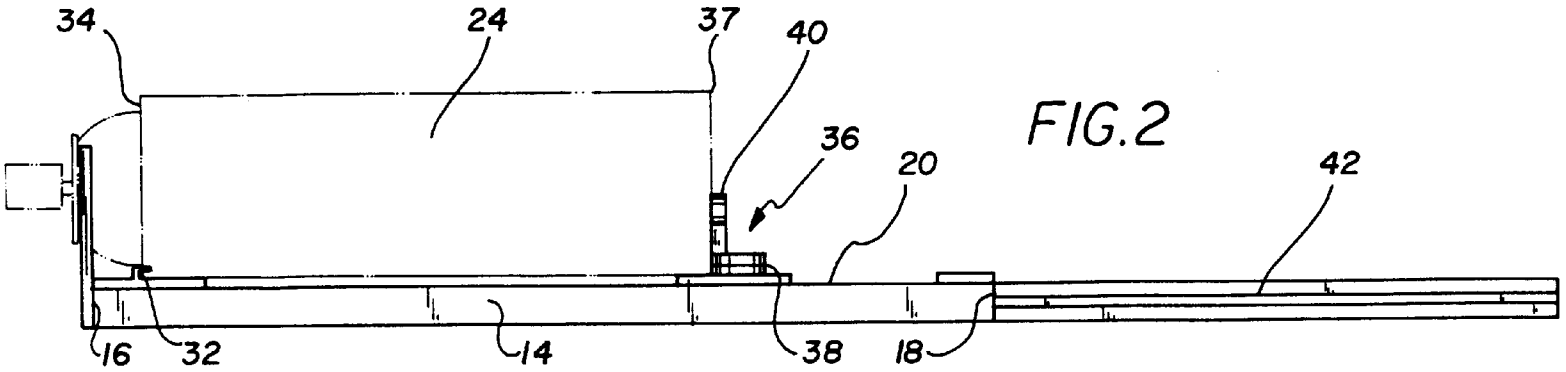
FIG. 2 side elevation view of the present invention.
Figure 3:
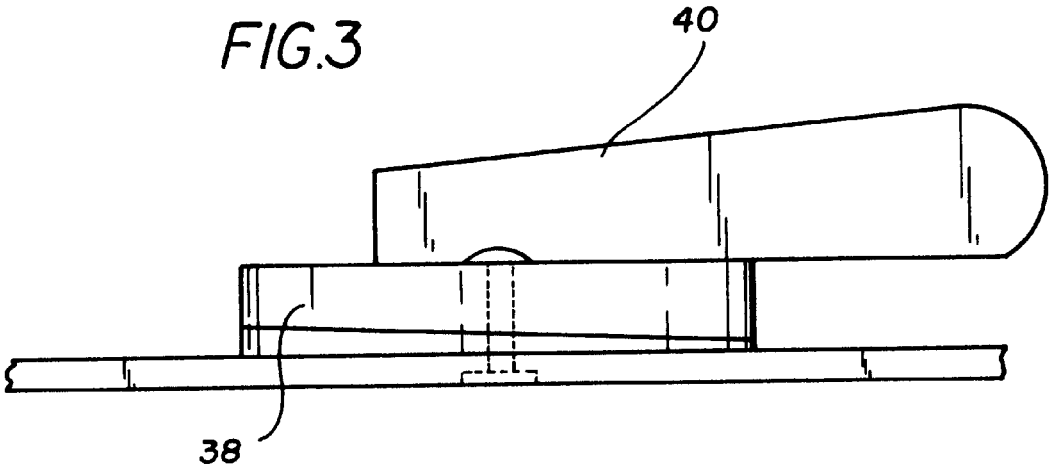
FIG. 3 is a rear elevation view of the adjustable bracket of the present invention.
Figure 4:
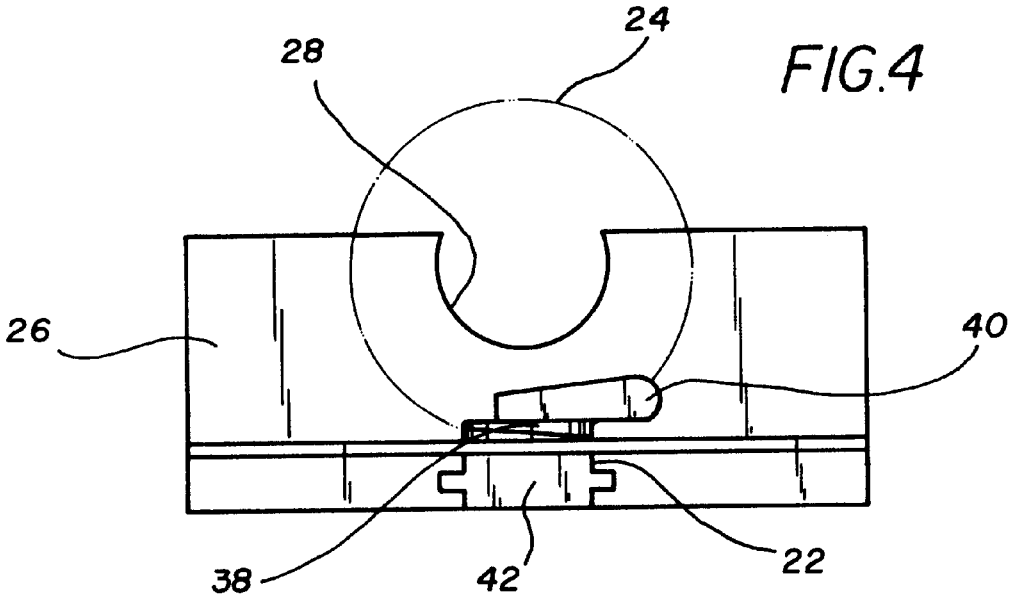
FIG. 4 is a rear elevation view the present invention.

With reference now to the drawings, and in particular, to FIGS. 1 through 4 thereof, the preferred embodiment of the new and improved log sizing and marking device embodying the principles and concepts of the present invention and generally designated by the reference number 10 will be described.

Specifically, it will be noted in the various Figures that the device relates to a log sizing and marking device for measuring logs for cutting at a desired length. In its broadest context, the device consists of a base member, an adjustable bracket and a sliding ruler. Such components are individually configured and correlated with respect to each other so as to attain the desired objective.

The base member 12 has a generally rectangular configuration. The base member 12 has long opposed side walls 14 and short opposed forward 16 and rearward end walls 18. The base member 12 has an upper surface 20 and a lower surface 22. The base member 12 has a slot 22 extending through the rearward end wall 18 and extending a length of the base member 12.

The adjustable bracket is secured to the upper surface 20 of the base member 12. The adjustable bracket is adapted for coupling a can of spray paint 24 to the base member 12 in a horizontally disposed orientation. The adjustable bracket includes a forward bracket 26 extending upwardly from the forward end wall 16 of the base member 12. The forward bracket 26 has an arcuate recess 28 extending downwardly thereof for receiving a spray nozzle 30 of the can of spray paint 24 therein. The forward bracket 26 includes a tab 32 extending inwardly therefrom for engaging an upper peripheral edge 34 of the can of spray paint 24. The adjustable bracket includes a rearward bracket 36 disposed inwardly of the rearward end wall 18 of the base member 12. The rearward bracket 36 comprises a cam lock 38 for releasably engaging a lower peripheral edge 37 of the can of spray paint 24. The cam lock 38 includes a release handle 40. The release handle 40 allows for the can of spray paint 24 to be removed as needed.

The sliding ruler 42 is slidably received within the slot 22 extending through the rearward end wall 18 of the base member 12.

The present invention is a tool that provides a fast, consistent, and easy way to mark logs into lengths for cutting into firewood.

The present invention consists of a fourteen inch long by 2½ inch wide base member 12 which has an adjustable bracket for holding a can of spray paint 24 and an adjustable length ruler 42. Any standard can of spray paint 24 can be placed within the provided bracket, where it is locked into position with a small cam lock 38.

The sliding ruler 42 is then pulled out from the rearward end 18 of the base member 12, and set to the desired length marking. Simply align the end of the base member 12 to one end of the log, spray a mark; move the ruler end to that mark, and continue in this manner along the length of the log to quickly and easily mark it into the correct lengths necessary for use in a woodstove or fireplace.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A log sizing and marking device for measuring logs for cutting at a desired length comprising, in combination:

a base member having a generally rectangular configuration, the base member having long opposed side walls and short opposed forward and rearward end walls, the base member having an upper surface and a lower surface, the base member having a slot extending through the rearward end wall and extending a length of the base member;

an adjustable bracket secured to the upper surface of the base member, the adjustable bracket adapted for coupling a can of spray paint to the base member in a horizontally disposed orientation, the adjustable bracket including a forward bracket extending upwardly from the forward end wall of the base member, the forward bracket having an arcuate recess extending downwardly thereof for receiving a spray nozzle of the can of spray paint therein, the forward bracket including a tab extending inwardly therefrom for engaging an upper peripheral edge of the can of spray paint, the adjustable bracket including a rearward bracket disposed inwardly of the rearward end wall of the base member, the rearward bracket comprising a cam lock for releasably engaging a lower peripheral edge of the can of spray paint, the cam lock including a release handle; and a sliding ruler slidably received within the slot extending through the rearward end wall of the base member.

2. A log sizing and marking device comprising:

a base member having a slot extending through a rearward end wall and extending a length thereof;

an adjustable bracket secured to an upper surface of the base member, the adjustable bracket adapted for coupling a can of spray paint to the base member in a horizontally disposed orientation; and a sliding ruler slidably received within the slot extending through the rearward end wall of the base member.

3. The log sizing and marking device as set forth in claim 2 wherein the adjustable bracket includes a forward bracket and a rearward bracket.

4. The log sizing and marking device as set forth in claim 3 wherein the forward bracket extends upwardly from the forward end wall of the base member, the forward bracket having an arcuate recess extending downwardly thereof for receiving a spray nozzle of the can of spray paint therein.

5. The log sizing and marking device as set forth in claim 4 wherein the forward bracket includes a tab extending inwardly therefrom for engaging an upper peripheral edge of the can of spray paint.

6. The log sizing and marking device as set forth in claim 3 wherein the rearward bracket is disposed inwardly of the rearward end wall of the base member, the rearward bracket comprises a cam lock for releasably engaging a lower peripheral edge of the can of spray paint.

7. The log sizing and marking device as set forth in claim 6 wherein the cam lock includes a release handle.

* * * * *